US006168219B1

(12) United States Patent
Futa

(10) Patent No.: US 6,168,219 B1
(45) **Date of Patent: *Jan. 2, 2001**

(54) GRAPPLE

(75) Inventor: David Futa, South Bend, IN (US)

(73) Assignees: David M. Futa, Barrington, IL (US); Carlton G. Smith, Latham, NY (US); Lance E. Long, Mishawaka, IN (US); Steven B. Begyn, Latham, NY (US); Jack Long, South Bend, IN (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/054,727

(22) Filed: Apr. 3, 1998

Related U.S. Application Data

(63) Continuation of application No. 08/693,972, filed on Aug. 8, 1996, now Pat. No. 5,762,388.

(51) Int. Cl.[7] ..... B66C 1/04; B66C 3/04

(52) U.S. Cl. ..... 294/3; 294/65.5; 294/88; 294/106; 414/606

(58) Field of Search ..... 294/2, 3, 65.5, 294/88, 106, 907, 68.23; 414/606, 737; 335/285, 291, 294; 37/182, 187; 901/40

(56) References Cited

U.S. PATENT DOCUMENTS

| | | | | |
|---|---|---|---|---|
| 762,759 | * | 6/1904 | Reuter . | |
| 916,374 | * | 3/1909 | Schnabel . | |
| 977,046 | * | 11/1910 | Schnabel . | |
| 1,094,106 | * | 4/1914 | White | 294/65.5 |
| 1,334,504 | * | 3/1920 | Parker . | |
| 1,489,284 | * | 4/1924 | Steininger | 294/65.5 |
| 1,590,020 | * | 6/1926 | Golden . | |
| 1,667,766 | * | 5/1928 | Bing . | |
| 1,957,719 | * | 5/1934 | Naugle et al. . | |
| 2,651,538 | * | 9/1953 | Stahmer . | |
| 2,761,094 | * | 8/1956 | Frampton . | |
| 2,787,874 | * | 4/1957 | Blood et al. . | |
| 2,850,189 | * | 9/1958 | Leroy . | |
| 2,882,458 | * | 4/1959 | Anderson et al. . | |
| 3,040,921 | * | 6/1962 | Davis . | |
| 3,265,939 | * | 8/1966 | Rinderer . | |
| 3,521,209 | * | 7/1970 | Fritz . | |
| 3,559,130 | * | 1/1971 | Schrader . | |
| 3,596,967 | * | 8/1971 | Carter . | |
| 3,763,453 | * | 10/1973 | Schurr . | |
| 3,799,602 | * | 3/1974 | Laws et al. . | |
| 3,963,126 | * | 6/1976 | Rybak | 335/291 |

(List continued on next page.)

FOREIGN PATENT DOCUMENTS

| | | | | |
|---|---|---|---|---|
| 2509003 | * | 9/1976 | (DE) | 294/65.5 |
| 0 224 002 A1 | | 6/1987 | (EP) . | |
| 0 411 227 A1 | | 2/1991 | (EP) . | |
| 26 651220 | * | 3/1991 | (FR) | 294/65.5 |
| 07215661 | | 8/1995 | (JP) . | |
| 590239 | * | 1/1978 | (SU) | 294/65.5 |

OTHER PUBLICATIONS

Dings magnetic group, "Electricore 8 scrap lifting magnets", Catalog No. 6200D, no date.*

"Welcome to Rotobec", advertising material, Jun. 1993.*

Rotobec literature with drawing, Jan. 1996.*

* cited by examiner

*Primary Examiner*—Dean J. Kramer
(74) *Attorney, Agent, or Firm*—Barnes & Thornburg

(57) ABSTRACT

A grapple includes a ferrous body with a plurality of tines pivotally connected thereto. A magnetic coil is disposed within the ferrous body. When the magnetic coil is energized, it creates a magnetic field within the area defined by the tines. The tines are also magnetized by the field. Additional magnetic coils may be added to one or more of the tines.

7 Claims, 3 Drawing Sheets

U.S. PATENT DOCUMENTS 3,984,796 * 10/1976 Frampton .
4,185,261 * 1/1980 Nagata ..... 294/65.5
4,264,887 * 4/1981 Barrett .
4,715,631 * 12/1987 Nakajima .
5,003,126 * 3/1991 Fujii et al. .
5,024,397 * 6/1991 Edwards et al. ..... 294/68.23
5,074,608 * 12/1991 Gabriel ..... 294/88
5,193,873 * 3/1993 Juliusz et al. ..... 294/68.23
5,264,981 * 11/1993 Campbell et al. .
5,312,674 * 5/1994 Haertling et al. .
5,330,242 * 7/1994 Lucky, Sr. ..... 294/88
5,410,289 * 4/1995 Futa .
5,411,304 * 5/1995 Muto et al. ..... 294/65.5
5,620,222 * 4/1997 Prinz ..... 294/88

GRAPPLE

This is a Continuation of application Ser. No. 08/693,972, filed Aug. 8, 1996 now U.S. Pat. No. 5,762,388.

BACKGROUND AND SUMMARY OF THE INVENTION

The present invention relates to grapples, and, in particular, to grapples with magnetic properties.

Numerous grapples are known in the prior art. Such devices are used for gathering and moving material, often of irregular shape. For example, grapples may be used to gather scrap metal into a pile and then transport it to another location, such as for further processing. Examples of various grapples are shown in U.S. Pat. Nos. 762,759; 1,590,020; and 2,850,189.

Grapples of this sort often include a plurality of tines that may be moved to open the grapple. The open grapple may then be placed on top of the material to be gathered and the tines closed about the material so as to contain it. The grapple can then be moved to another location where the tines are opened to release the materials.

As the materials to be lifted and moved by the grapple are often of irregular size and shape and because the tines of the grapple, even when closed, do not form a complete enclosure, material that is initially gathered into the grapple sometimes falls out during transport. This may result in the deposit of material where it is not desired. This increases the amount of work to be performed, as the material that has fallen from the grapple must be gathered at a later point.

Accordingly, it is an object of the present invention to provide a grapple.

Another object of the present invention is to provide a grapple that reduces the amount of material that falls from the tines.

Still another object of the present invention is to provide a grapple useful for gathering and transporting metal material.

These and other objects of the present invention are attained by the provision of a grapple comprising a body having an upper surface, a lower surface and a side surface disposed between the upper and lower surfaces. A plurality of tines each having a first end and a second end are pivotally connected to the body below the upper surface. A magnetic coil is disposed at least partially within the body.

According to another embodiment of the present invention, the body incudes a pair of spaced apart ears corresponding to each of the tines and each of the tines is pivotally connected to at least one of the pairs of ears. The pairs of spaced apart ears may be disposed uniformly about the body. A portion of the tines may be located between the corresponding pair of spaced apart ears. The tines may be connected to the body above the lower surface thereof.

According to another embodiment of the present invention, the magnetic coil is disposed a least partially within a nonferrous housing.

According to another embodiment of the present invention, the grapple includes a second magnetic coil connected to at least one of the plurality of tines. The second magnetic coil may be wound about a portion of the tine. The tine may be made from a ferrous material. A protective skin may be disposed adjacent a portion of the second magnetic coil. The second magnetic coil may be disposed at least partially within a nonferrous housing.

According to another embodiment of the present invention, a portion of the magnetic coil is located in the same horizontal plane as the point of connection between the plurality of tines and the body.

According to another embodiment of the present invention, a grapple includes a body having an upper surface, a lower surface and a side surface disposed between the upper and lower surfaces. A plurality of tines each having a first end and a second end is connected to the body. A magnetic coil is connected to at least one of the plurality of tines.

According to another embodiment of the present invention, the magnetic coil is wound about a portion of at least one of the plurality of tines. At least a portion of one of the plurality of tines is made from a ferrous material. A protective skin may be disposed adjacent a portion of the magnetic coil. The magnetic coil may be disposed at least partially within a nonferrous housing.

According to another embodiment of the present invention, the tines are pivotally connected to the body. The tines may be connected to the body below the upper surface.

Other aspects, characteristics and advantages of the present invention will become apparent from the detailed description which follows, and the accompanying drawings.

DETAILED DESCRIPTION OF THE PREFERRED EMBODIMENTS

Figure 1:
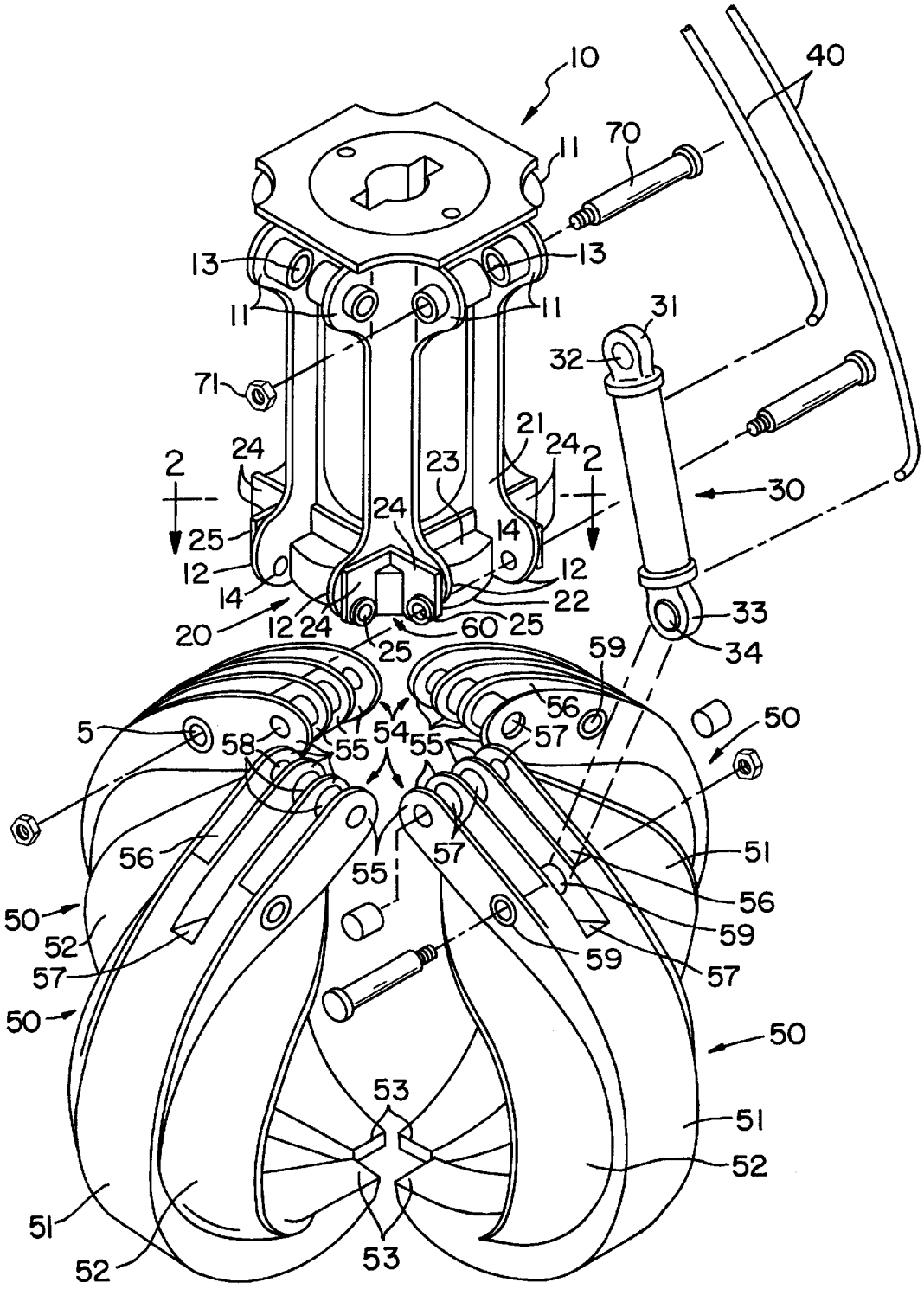
FIG. 1 is an exploded view of a grapple according to the present invention.

FIG. 1 is an exploded view of a grapple according to the present invention. The grapple generally comprises head assembly 10, ferrous body 20, cylinders 30, hoses 40, a plurality of tines 50 and magnetic coil 60.

Head assembly 10 includes a plurality of top ears 11 and bottom ears 12 spaced thereabout in pairs. Top ears 11 each include a hole 13 therethrough. Each bottom ear 12 includes a hole 14 therethrough. Top ears 11 and bottom ears 12 are used to secure cylinders 30 and tines 50, respectively, to head assembly 10 as described below.

Ferrous body 20 is generally located within the space defined by bottom ears 12 and includes a top surface 21, a bottom surface 22 and a continuous side surface 23. A plurality of ears 24 extend from ferrous body 20 and are arranged in pairs spaced evenly about ferrous body 20. One pair of ears 24 corresponds to each pair of bottom ears 12. Ears 24 each include a hole 25 therein. Holes 25 lie along the same axis as holes 14 in the corresponding pair of bottom ears 12.

Each cylinder 30 includes a top ear 31 having a hole 32 therein and a bottom ear 33 having hole 34 therein. Top ear 31 is placed between a pair of corresponding top ears 11 on head assembly 10 and a bolt or pin 70 is inserted through holes 13 and 34 and secured with a nut 71. In this manner, one end of cylinder 30 is secured to head assembly 10. Although only one cylinder 30 is shown, four would be used for the grapple shown, one for each tine 50. Hoses 40 are connected at one end to cylinders 30 and at the other end to a source of hydraulic fluid, as is known in the art, to operated cylinders 30.

Each tine 50 is a generally curved member, including a main portion 51, an outer skin 52, a first end 53 and a second end 54. At second end 54, each tine 50 is separated into a plurality of arms 55 separated by two outer slots 56 and one inner slot 57. Note that inner slot 57 in each tine 50 extends below the two outer slots 56. A hole 58 extends through each arm 55 at second end 54 of tines 50 and is in communication with slots 56 and 57. A second hole 59 extends through each tine 50 and is in communication with at least inner slot 57. Main portion 51 of tines 50 are preferably constructed from a 1020 steel. Outer skin 52 is preferably constructed from a nonferrous material.

Tines 50 are secured to head assembly 10 by positioning a pair of lower ears 12 within outer slots 56 in a tine 50 and inserting a bolt or pin 70 through holes 58 and 14 and securing with a nut 71. Bottom ear 33 of a cylinder 30 is inserted into inner slot 57 of tine 50 a secured thereto by inserting a bolt 70 through second holes 59 and hole 34 and securing with a nut 71.

When cylinders 30 are pressurized to extend them, bottom ears 33 will bear against the bolts or pins joining them to tines 50 and cause tines 50 to pivot outwardly. When cylinders 30 are depressurized to retract them, top ears 31 will pull on bolts or pins 70 joining them to tines 50, thereby closing tines 50.

Figure 2:
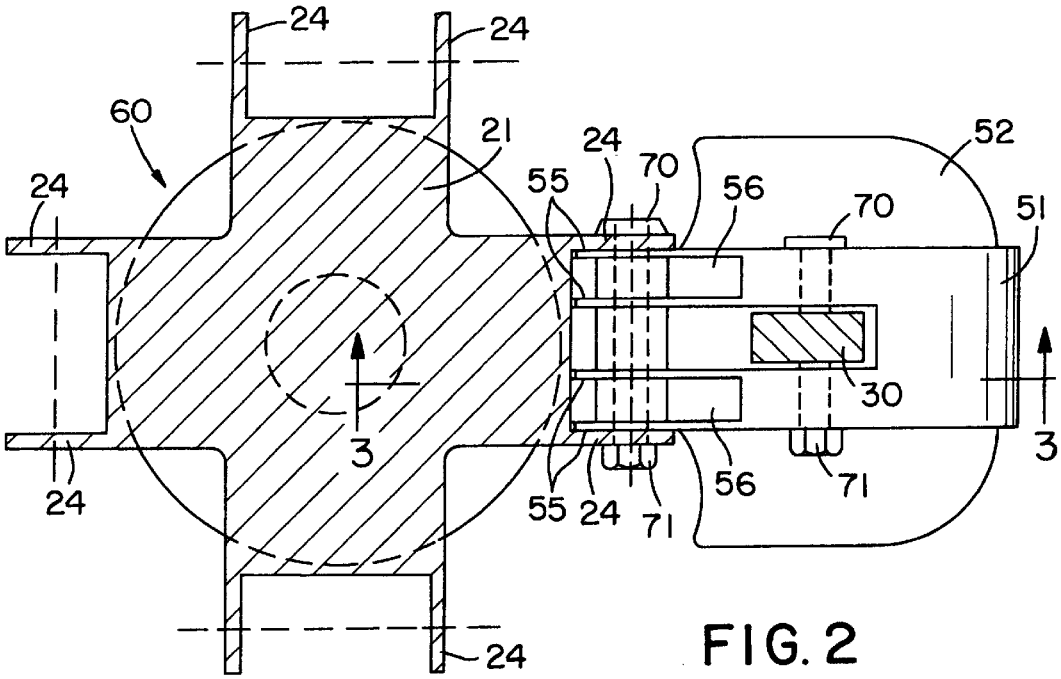
FIG. 2 is a cross-sectional view taken just above top surface 21 of ferrous body 20 in FIG. 1 with one tine 50 secured thereto.

FIG. 2 is a cross-sectional view taken just above top surface 21 of ferrous body 20 in FIG. 1 with one tine 50 secured thereto. FIG. 2 illustrates how ears 24 of ferrous body 20 straddle the outer-most arms 55 of tines 50, while bottom ears 13 of head assembly 10 are disposed between arms 55 within outer slots 56. FIG. 2 further shows how magnetic coil 60 is positioned relative to ferrous body 20.

Figure 3:
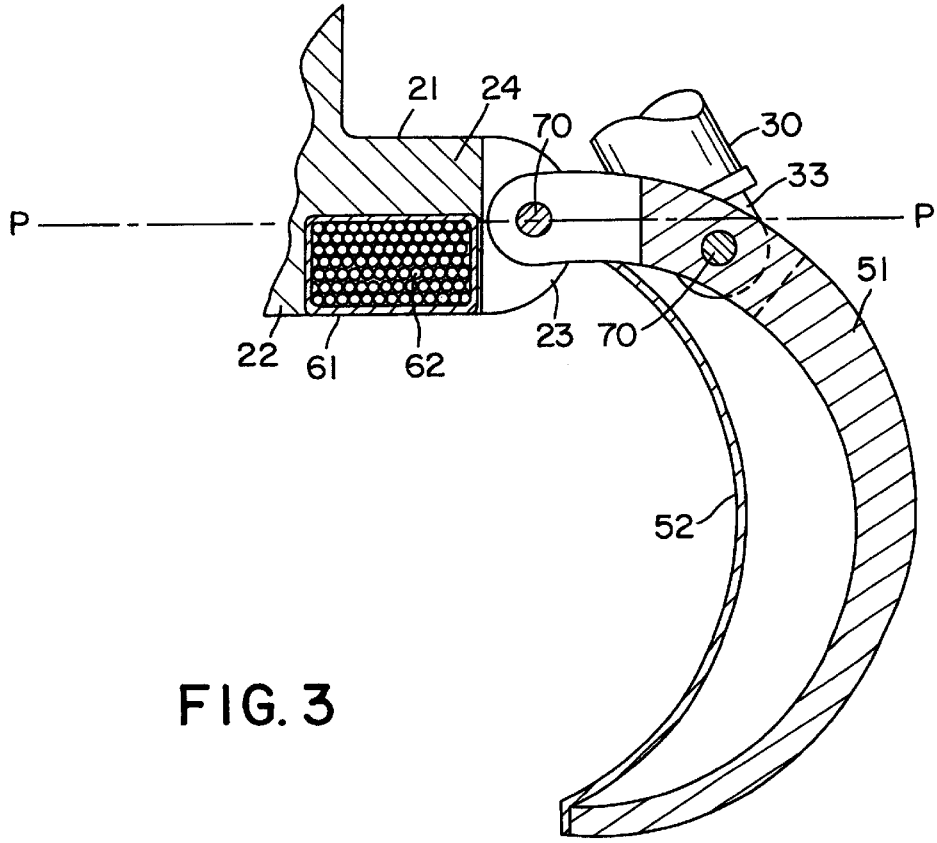
FIG. 3 is a cross-sectional view taken along line 3—3 FIG. 2.

FIG. 3 is a cross-sectional view taken along line 3—3 in FIG. 2. In this view, it can be seen that each tine 50 includes a central portion 51 disposed within outer skin 52. FIG. 3 further illustrates that magnetic coil 60 includes a non-ferrous casing or housing 61 surrounding coil 62. Magnetic coil 60 is positioned in ferrous body 20 such that a portion of ferrous body 20 forms the core of magnetic coil 60. Note also that magnetic coil 60 is positioned such that at least a portion of it lies in the same horizontal plane P—P as a portion of bolt or pin 70 that connects tine 50 to ferrous body 20. This positioning of magnetic coil 60 and tines 50 places magnetic coil 60 almost completely outside the area defined by tines 50, thereby providing a greater area which may be occupied by the material to be moved by the grapple.

Coil 62 is connected to a current source by any one of a number of means known in the prior art. When current is passed through coil 62, a magnetic field is generated within the space defined by tines 50. This field magnetizes ferrous body 20. Tines 50, being preferably manufactured from ferrous material, are likewise magnetized. Thus, tines 50 will be better able to gather ferrous items because of the magnetic field generated.

Figure 4:
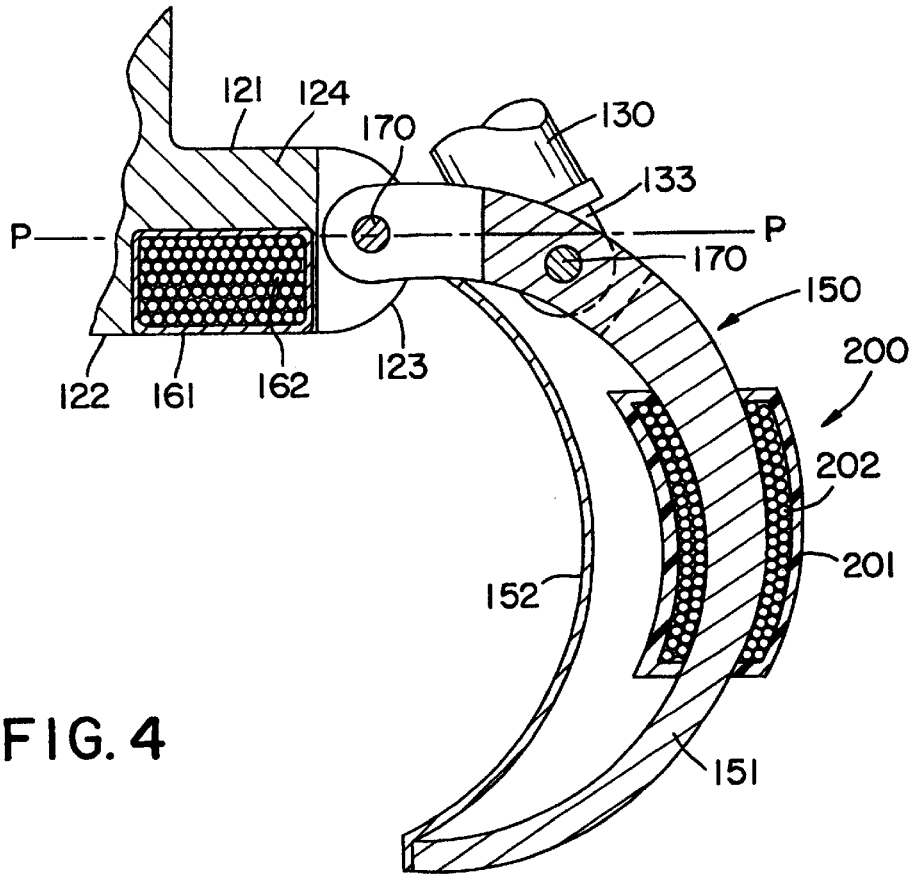
FIG. 4 is a cross-sectional view like that of FIG. 3 for an alternative embodiment of a grapple according to the present invention.

Another embodiment of the present invention is shown in FIG. 4 wherein the numeral "1" has been added in front of the remainder of the numerical designation to indicate corresponding parts with the previous embodiment. In this embodiment, a magnetic coil 200 has been added to tine 150. Magnetic coil 200 includes a non-ferrous shell or housing 201 containing coil 202. Coil 202 is wound about central portion 151 of tine 150. Central portion 151 is made from a ferrous material and forms the core of magnetic coil 202. Coil 202 is connected to a source of current by any suitable means known in the prior art. When current is passed through coil 202, a magnetic field is generated within the area defined by the tines 150. The magnetic field also magnetizes tine 150. Such a magnet 200 may be added to as many tines 150 as desired. Note that in this embodiment, ferrous body 120 also includes a magnetic coil.

Figure 5:
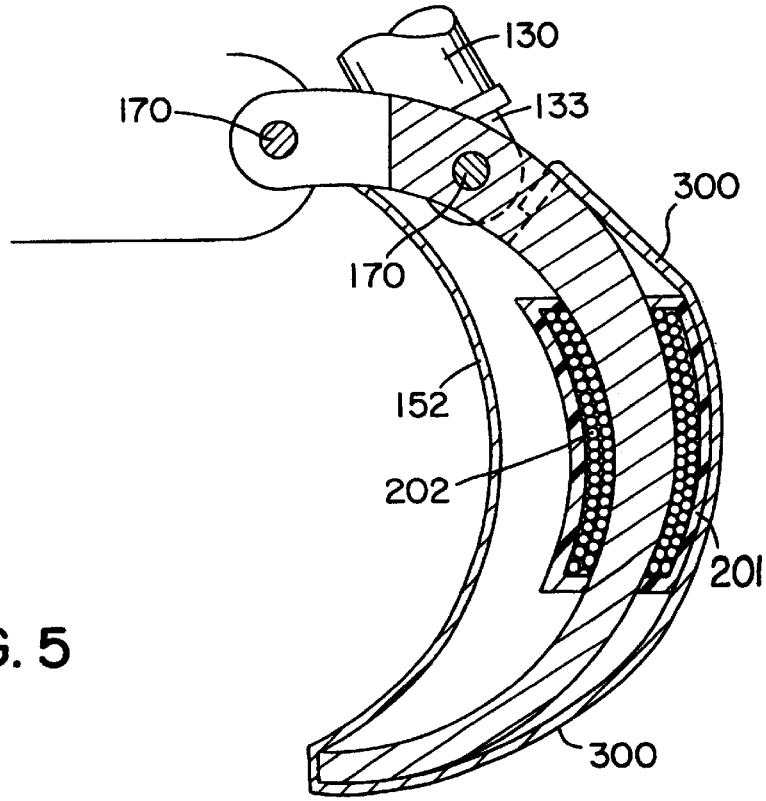
FIG. 5 is a cross-sectional view like that of FIG. 3 for an alternative embodiment of a grapple according to the present invention.

FIG. 5 shows yet another embodiment of the present invention. This embodiment is the same as that shown in FIG. 4 except that an additional protective skin 300 has been added to the back of tine 150 to protect magnetic coil 200. Protective skin 300 is preferably made from a nonferrous material.

Although the present invention has been shown and described in detail, it should be understood that the same is to be taken by way of example only and not by way of limitation. Numerous changes can be made to the embodiments of the present invention without removing it from the scope thereof. For example, ferrous body 120 and magnetic coil 161 could be completely removed from the embodiment of FIG. 4. In such an embodiment, only magnetic coil 200, on one or more tines 150, would be utilized. Also, ferrous body 20 can be made in any desired shape. Any number of tines can be utilized and although they are preferably spaced evenly about the ferrous body, they do not have to be. The present invention can also be utilized with tines and head assemblies of configurations different from those illustrated. Accordingly, the scope of the present invention is to be limited only by the terms of the claims appended hereto.

What is claimed is:

1. A tine for use with a grapple, comprising:

a first end and a second end;

a plurality of arms separated by a pair of outer slots and at least one inner slot located at the first end for pivotally attaching the tine to a portion of the grapple;

a first portion extending between the first and second ends;

wherein the inner slot extends further into the first portion relative to the pair of outer slots; and at least one magnetic coil wound about part of the first portion.

2. The tine according to claim 1, wherein the first portion of the tine is made from a ferrous material.

3. The tine according to claim 1, further comprising a skin near a portion of the magnetic coil.

4. The tine according to claim 3, wherein the skin is made of a nonferrous material.

5. The tine according to claim 1, further comprising a skin connected to the first portion of the tine.

6. The tine according to claim 1, wherein the magnetic coil is located at least partially within a nonferrous housing.

7. The tine according to claim 1, wherein the first portion of the tine is curved.

* * * * *